US009304426B2

(12) United States Patent
Ozawa et al.

(10) Patent No.: US 9,304,426 B2
(45) Date of Patent: Apr. 5, 2016

(54) ELECTROSTATIC LATENT IMAGE DEVELOPING TONER

(71) Applicant: KYOCERA Document Solutions Inc., Osaka (JP)

(72) Inventors: Yoshio Ozawa, Osaka (JP); Masami Tsujihiro, Osaka (JP); Toru Takatsuna, Osaka (JP); Ryotaro Komada, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 42 days.

(21) Appl. No.: 14/316,348

(22) Filed: Jun. 26, 2014

(65) Prior Publication Data

US 2015/0004537 A1 Jan. 1, 2015

(30) Foreign Application Priority Data

Jun. 27, 2013 (JP) ..... 2013-135440

(51) Int. Cl.
*G03G 9/08* (2006.01)
*G03G 9/093* (2006.01)

(52) U.S. Cl.
CPC ..... *G03G 9/09328* (2013.01); *G03G 9/09314* (2013.01); *G03G 9/09371* (2013.01); *G03G 9/09385* (2013.01); *G03G 9/09392* (2013.01)

(58) Field of Classification Search
CPC ..... G03G 9/09314
USPC ..... 430/110.2
See application file for complete search history.

(56) References Cited

U.S. PATENT DOCUMENTS 4,980,257 A * 12/1990 Anno et al. ..... 430/110.2
2005/0271964 A1 12/2005 Etou et al.

FOREIGN PATENT DOCUMENTS

JP 2004-138985 A 5/2004

* cited by examiner

*Primary Examiner* — Mark A Chapman
(74) *Attorney, Agent, or Firm* — Studebaker & Brackett PC

(57) ABSTRACT

The present disclosure relates to an electrostatic latent image developing toner containing a toner particle including a toner core containing a binder resin and a shell layer coating a surface of the toner core. The shell layer contains a unit derived from a monomer of a thermosetting resin, and a unit derived from a thermoplastic resin. The thermosetting resin is one or more resins selected from the group of amino resins consisting of a melamine resin, a urea resin, and a glyoxal resin. The toner particle contains fine particles in an interfacial portion between the toner core and the shell layer, and the fine particles have a charge property opposite to that of the toner, or have a volume resistivity lower than both a volume resistivity of the binder resin and a volume resistivity of the shell layer.

12 Claims, 1 Drawing Sheet

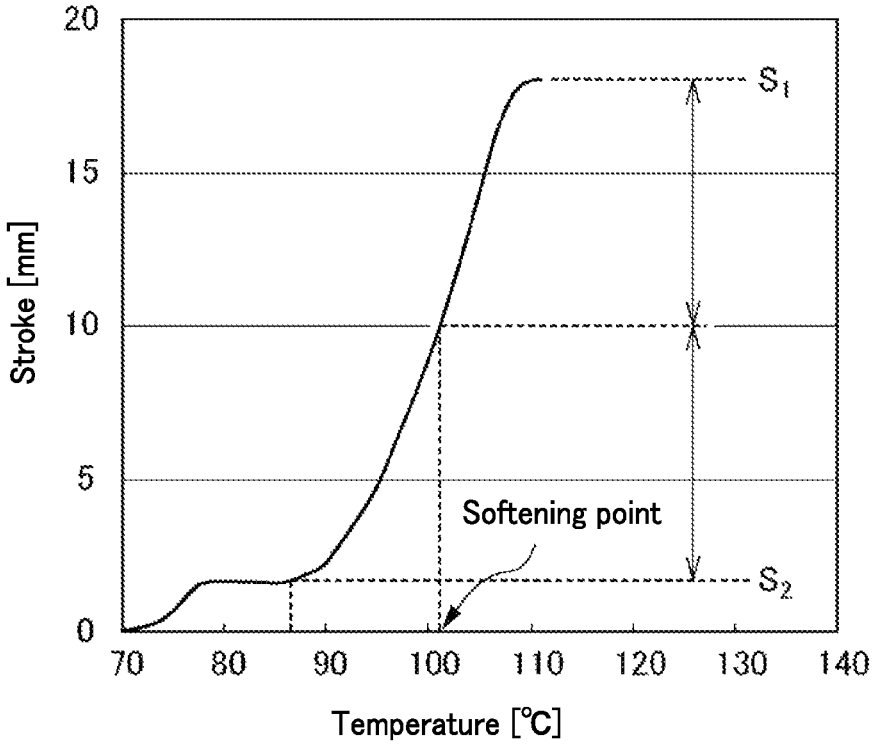
20
15
10
5
0
Stroke [mm]
70
80
90
100
110
120
130
140
Temperature [°C]
S1
S2
Softening point

ELECTROSTATIC LATENT IMAGE DEVELOPING TONER

INCORPORATION BY REFERENCE

The present application claims priority under 35 U.S.C. §119 to Japanese Patent Application No. 2013-135440, filed Jun. 27, 2013. The contents of this application are incorporated herein by reference in their entirety.

BACKGROUND

The present disclosure relates to an electrostatic latent image developing toner.

In order to realize an energy-saving or compact image forming apparatus, there is a demand for a toner excellent in low-temperature fixability. When a toner excellent in the low-temperature fixability is used, the toner can be satisfactorily fixed on a recording medium even if the temperature of a fixing roller is low. In order to obtain a toner excellent in the low-temperature fixability, a method for producing a toner by using a binder resin having a low melting point (or a binder resin having a low glass transition point) and a release agent having a low melting point has been proposed. It is, however, difficult to produce a toner excellent in high-temperature preservability by this method. The high-temperature preservability of a toner refers to a property that toner particles contained in the toner are not aggregated even if the toner is stored under a high temperature environment. In a toner poor in the high-temperature preservability, toner particles are liable to aggregate under a high temperature environment. When the toner particles aggregate, the charge amount of the toner particles are likely to be lowered.

For purpose of improving the low-temperature fixability, high-temperature preservability, and blocking resistance of a toner, a toner containing a toner particle having a core-shell structure has been proposed. In an exemplified toner containing a toner particle having a core-shell structure, a toner core contains a binder resin having a low melting point. Besides, the toner core is coated with a shell layer. In addition, a resin constituting the shell layer has a higher glass transition point (Tg) than the binder resin contained in the toner core.

In the toner containing the toner particle having the core-shell structure, the surface of the toner core is coated with a thin film (shell layer) containing a thermosetting resin. The toner core has a softening point of 40° C. or more and 150° C. or less.

SUMMARY

An electrostatic latent image developing toner of the present disclosure includes a toner particle having a toner core containing a binder resin and a shell layer coating a surface of the toner core. The shell layer contains a unit derived from a monomer of a thermosetting resin, and a unit derived from a thermoplastic resin. The thermosetting resin is one or more resins selected from the group of amino resins consisting of a melamine resin, a urea resin, and a glyoxal resin. The toner particle contains fine particles in an interfacial portion between the toner core and the shell layer. The fine particles have a charge property opposite to that of the toner, or have a volume resistivity lower than those of both the binder resin and the shell layer.

BRIEF DESCRIPTION OF THE DRAWING

FIG. 1 is a diagram explaining a method for measuring a softening point by using an elevated flow tester.

DETAILED DESCRIPTION

An embodiment of the present disclosure will now be described in details. The present disclosure is not limited to the following embodiment at all but can be practiced with changes and modifications appropriately made within the scope of the object of the present disclosure. Incidentally, the description may be appropriately omitted in some cases for avoiding redundant description, which does not limit the gist of the present disclosure.

A toner according to the present embodiment is an electrostatic latent image developing toner. Each toner particle contained in the toner has a toner core and a shell layer. The toner core contains at least a binder resin. The shell layer coats the toner core. Fine particles are contained in an interfacial portion between the toner core and the shell layer. The fine particles have a charge property opposite to that of the toner. Alternatively, the fine particles have a prescribed volume resistivity. The toner core may contain, in the binder resin, a component such as a coloring agent, a release agent, a charge control agent, or a magnetic powder if necessary. The shell layer is mainly constituted by a resin. The resin constituting the shell layer contains a unit derived from a monomer of a thermosetting resin, and a unit derived from a thermoplastic resin.

The toner may contain the toner particles alone, or may contain a component other than the toner particles. An external additive may be adhered to the surface of the toner particle as occasion demands. The toner may be mixed with a desired carrier, so as to be prepared as a two-component developer. Now, the toner core (the binder resin, the coloring agent, the release agent, the charge control agent, and the magnetic powder), the fine particles, the shell layer, the external additive, the carrier used when the toner is used as a two-component developer, and a method for producing the toner will be successively described.

[Binder Resin]

In the toner of the present embodiment, the shell layer is formed on the surface of the toner core through a reaction, caused on the surface of the toner core, between the thermoplastic resin and the monomer of the thermosetting resin. The toner core is coated with the shell layer. Therefore, the binder resin is preferably a resin having, in a molecule, at least one of functional groups of a hydroxyl group, a carboxyl group, and an amino group, and is more preferably a resin having, in a molecule, a hydroxyl group and/or a carboxyl group. A hydroxyl group reacts with and chemically binds to a monomer of a thermosetting resin such as methylol melamine. Accordingly, if the toner is produced by using a binder resin having a hydroxyl group, the shell layer firmly bound to the toner core in the toner can be prepared.

If the binder resin has a carboxyl group, the binder resin has an acid value of preferably 3 mgKOH/g or more and 50 mgKOH/g or less, and more preferably 10 mgKOH/g or more and 40 mgKOH/g or less. If the binder resin has a hydroxyl group, the binder resin has a hydroxyl value of preferably 10 mgKOH/g or more and 70 mgKOH/g or less, and more preferably 15 mgKOH/g or more and 50 mgKOH/g or less.

Specific examples of the binder resin include thermoplastic resins (such as styrene resins, acrylic resins, styrene acrylic resins, polyethylene resins, polypropylene resins, vinyl chloride resins, polyester resins, polyamide resins, polyurethane resins, polyvinyl alcohol resins, vinyl ether resins, N-vinyl resins, and styrene-butadiene resins). Among these resins, a styrene acrylic resin or a polyester resin is preferably used from the viewpoint of improvement of the dispersibility of a coloring agent in the toner particles, the chargeability of the toner, and the fixability of the toner on a recording medium. The styrene acrylic resin and the polyester resin will now be described.

The styrene acrylic resin is a copolymer of a styrene monomer and an acrylic monomer. Specific examples of the styrene monomer include styrene, α-methylstyrene, p-hydroxystyrene, m-hydroxystyrene, vinyl toluene, α-chlorostyrene, o-chlorostyrene, m-chlorostyrene, p-chlorostyrene, and p-ethylstyrene. Specific examples of the acrylic monomer include (meth)acrylic acid, (meth)acrylic acid alkyl ester (such as methyl (meth)acrylate, ethyl (meth)acrylate, n-propyl (meth)acrylate, iso-propyl (meth)acrylate, n-butyl (meth) acrylate, iso-butyl (meth)acrylate, or 2-ethylhexyl (meth) acrylate)), and (meth)acrylic acid hydroxyalkyl ester (such as 2-hydroxyethyl (meth)acrylate, 3-hydroxypropyl (meth) acrylate, 2-hydroxypropyl (meth)acrylate, or 4-hydroxypropyl (meth)acrylate).

In preparation of the styrene acrylic resin, a hydroxy group can be introduced into the styrene acrylic resin by using a monomer such as p-hydroxystyrene, m-hydroxystyrene, or hydroxyalkyl ester (meth)acrylate. By appropriately adjusting the amount of such a monomer having a hydroxyl group to be used, the hydroxyl value of the resultant styrene acrylic resin can be adjusted.

In preparation of the styrene acrylic resin, a carboxyl group can be introduced into the styrene acrylic resin by using (meth)acrylic acid as the monomer. By appropriately adjusting the amount of the (meth)acrylic acid to be used, the acid value of the resultant styrene acrylic resin can be adjusted.

The polyester resin can be obtained by condensation polymerization or co-condensation polymerization of a bivalent, trivalent, or higher valent alcohol and a bivalent, trivalent, or higher valent carboxylic acid. Examples of components used in synthesizing the polyester resin include the following alcohols and carboxylic acids:

Specific examples of a bivalent alcohol component used in synthesizing the polyester resin include diols (such as ethylene glycol, diethylene glycol, triethylene glycol, 1,2-propanediol, 1,3-propanediol, 1,4-butanediol, neopentyl glycol, 1,4-butenediol, 1,5-pentanediol, 1,6-hexanediol, 1,4-cyclohexanedimethanol, dipropylene glycol, polyethylene glycol, polypropylene glycol, and polytetramethylene glycol) and bisphenols (such as bisphenol A, hydrogenated bisphenol A, polyoxyethylene-modified bisphenol A, and polyoxypropylene-modified bisphenol A).

Specific examples of a trivalent or higher valent alcohol component used in synthesizing the polyester resin include sorbitol, 1,2,3,6-hexanetetrol, 1,4-sorbitan, pentaerythritol, dipentaerythritol, tripentaerythritol, 1,2,4-butanetriol, 1,2,5-pentanetriol, glycerol, diglycerol, 2-methyl propanetriol, 2-methyl-1,2,4-butanetriol, trimethylolethane, trimethylolpropane, and 1,3,5-trihydroxymethylbenzene.

Specific examples of a bivalent carboxylic acid component used in synthesizing the polyester resin include bivalent carboxylic acids (such as maleic acid, fumaric acid, citraconic acid, itaconic acid, glutaconic acid, phthalic acid, isophthalic acid, terephthalic acid, cyclohexane dicarboxylic acid, succinic acid (alkyl succinic acid or alkenyl succinic acid), adipic acid, sebacic acid, azelaic acid, and malonic acid). Besides, specific examples of the alkyl succinic acid and alkenyl succinic acid include n-butyl succinic acid, n-butenyl succinic acid, isobutyl succinic acid, isobutenyl succinic acid, n-octyl succinic acid, n-octenyl succinic acid, n-dodecyl succinic acid, n-dodecenyl succinic acid, isododecyl succinic acid, and isododecenyl succinic acid.

Specific examples of a trivalent or higher valent carboxylic acid component used in synthesizing the polyester resin include 1,2,4-benzenetricarboxylic acid (trimellitic acid), 1,2,5-benzenetricarboxylic acid, 2,5,7-naphthalenetricarboxylic acid, 1,2,4-naphthalenetricarboxylic acid, 1,2,4-butanetricarboxylic acid, 1,2,5-hexanetricarboxylic acid, 1,3-dicarboxyl-2-methyl-2-methylene carboxy propane, 1,2,4-cyclohexanetricarboxylic acid, tetra(methylenecarboxyl) methane, 1,2,7,8-octanetetracarboxylic acid, pyromellitic acid, and Empol trimer acid.

Furthermore, any of the aforementioned bivalent, trivalent, or higher valent carboxylic acid components may be used in the form of an ester-forming derivative such as an acid halide, an acid anhydride, or a lower alkyl ester. Here, a "lower alkyl" means an alkyl group having 1 to 6 carbon atoms.

The acid value and the hydroxyl value of the polyester resin can be adjusted by appropriately changing the amount of a bivalent, trivalent or higher valent alcohol component and the amount of a bivalent, trivalent or higher valent carboxylic acid component to be used in producing the polyester resin. Besides, the acid value and the hydroxy value of the polyester resin tend to be lowered by increasing the molecular weight of the polyester resin.

From the viewpoint of carbon neutral, the toner preferably contains a biomass-derived material. Specifically, a ratio of biomass-derived carbon in entire carbon contained in the toner is preferably 25% by mass or more and 90% by mass or less.

In order to attain the aforementioned range of the ratio of biomass-derived carbon in the entire carbon contained in the toner, if the binder resin is a polyester resin, a polyester resin synthesized by using a biomass-derived alcohol (such as 1,2-propanediol, 1,3-propanediol, or glycerin) is preferably used.

The type of biomass is not especially limited, and the biomass may be plant biomass or animal biomass. Among various biomass-derived materials, a plant biomass-derived material is more preferably used because such a material is easily available in a large amount and is inexpensive.

An example of a method for producing glycerin from biomass includes a method in which vegetable oil or animal oil is hydrolyzed by a chemical method using an acid or a base, or by a biological method using an enzyme or microorganism. Alternatively, glycerin may be produced from a substrate containing saccharides such as glucose by a fermentation method. Alcohol such as 1,2-propanediol or 1,3-propanediol can be produced by using, as a raw material, the glycerin obtained as described above. The glycerin can be chemically transformed into a target substance (an alcohol) by a known method.

As the binder resin, a styrene acrylic resin synthesized by using biomass-derived acrylic acid or acrylate is preferably used. By dehydrating the glycerin obtained as described above, acrolein can be obtained. Besides, by oxidizing the thus obtained acrolein, biomass-derived acrylic acid can be obtained. Furthermore, by esterifying the thus obtained biomass-derived acrylic acid by a known method, biomass-derived acrylate can be produced. If alcohol used in producing acrylate is methanol or ethanol, alcohol produced from biomass by a known method is preferably used.

In $CO_2$ present in the air, the concentration of $CO_2$ containing radioactive carbon ($^{14}C$) is retained constant in the air. On the other hand, plants incorporate $CO_2$ containing $^{14}C$ from the air during photosynthesis. Therefore, the concentration of $^{14}C$ in carbon contained in an organic component of a plant is occasionally equivalent to the concentration of $CO_2$ containing $^{14}C$ in the air. The concentration of $^{14}C$ in carbon contained in an organic component of a general plant is approximately 107.5 pMC (percent Modern Carbon). Besides, carbon present in animals is derived from carbon contained in plants. Therefore, the concentration of $^{14}C$ in carbon contained in an organic component of an animal also shows a similar tendency to that in a plant.

Assuming that the concentration of $^{14}C$ in the toner is X (pMC), the ratio of biomass-derived carbon in entire carbon contained in the toner can be obtained in accordance with formula (1): Ratio of biomass-derived carbon (mass %)=(X/107.5)×100.

From the viewpoint of the carbon neutral, a plastic product containing biomass-derived carbon in a ratio of 25% by mass or more in entire carbon contained in the product is particularly preferred. Such a plastic product is given a BiomassPla mark (certified by Japan BioPlastics Association). In the case where the ratio of the biomass-derived carbon in entire carbon contained in the toner is 25% by mass or more, the concentration X of $^{14}C$ in the toner is obtained in accordance with the above formula (1) as 26.9 pMC or more. Accordingly, the polyester resin is preferably prepared so that the concentration of the radioactive carbon isotope $^{14}C$ in the entire carbon contained in the toner can be 26.9 pMC or more. Incidentally, the concentration of $^{14}C$ in carbon contained in a petrochemical can be measured in accordance with ASTM-D6866.

The glass transition point ($Tg_r$) of the binder resin is preferably 30° C. or more and 60° C. or less, and more preferably 35° C. or more and 55° C. or less. The glass transition point ($Tg_r$) of the binder resin can be measured by the following method.

<Method for Measuring Glass Transition Point>

The glass transition point ($Tg_r$) of the binder resin can be obtained on the basis of a heat absorption curve of the binder resin (more specifically, a point of change in specific heat of the binder resin) obtained by using a differential scanning calorimeter (DSC) (such as "DSC-6200" manufactured by Seiko Instruments Inc.). For example, 10 mg of the binder resin (measurement sample) is put in an aluminum pan, and an empty aluminum pan is used as a reference. A heat absorption curve of the binder resin is obtained through measurement performed under conditions of a measurement temperature range from 25° C. to 200° C. inclusive and a temperature increasing rate of 10° C./min. The glass transition point ($Tg_r$) of the binder resin can be obtained based on this heat absorption curve of the binder resin.

The binder resin has a softening point ($Tm_r$) of preferably 60° C. or more and 150° C. or less, and more preferably 70° C. or more and 140° C. or less. Alternatively, a plurality of resins having different softening points (Tm) can be combined to obtain a binder resin having a softening point ($Tm_r$) falling in the aforementioned range. The softening point ($Tm_r$) of the binder resin can be measured by the following method.

<Method for Measuring Softening Point>

The softening point ($Tm_r$) of the binder resin can be measured by using an elevated flow tester (such as "CFT-500D" manufactured by Shimadzu Corporation). For example, the softening point ($Tm_r$) can be measured by setting the binder resin (measurement sample) on the elevated flow tester and causing 1 $cm^3$ of the sample to be melt flown under conditions of a die diameter of 1 mm, a plunger load of 20 $kg/cm^2$, and a temperature increasing rate of 6° C./min. By the measurement with the elevated flow tester, an S shaped curve pertaining to the temperature (° C.)/stroke (mm) can be obtained. The softening point ($Tm_r$) of the binder resin can be read from the thus obtained S shaped curve.

A method for reading the softening point ($Tm_r$) of the binder resin will be described with reference to FIG. 1. By the measurement with the elevated flow tester, an S shaped curve, for example, as illustrated in FIG. 1 can be obtained. It is assumed in this S shaped curve that the maximum value of the stroke is $S_1$ and that a stroke value corresponding to a low-temperature-side base line is $S_2$. On the S shaped curve, a temperature corresponding to a stroke value of $(S_1+S_2)/2$ corresponds to the softening point ($Tm_r$) of the binder resin (measurement sample).

If a polyester resin is used as the binder resin, the polyester resin has a number average molecular weight (Mn) of preferably 1200 or more and 2000 or less. A molecular weight distribution (Mw/Mn) of the polyester resin is preferably 9 or more and 20 or less. The molecular weight distribution of the polyester resin is expressed as a ratio between the number average molecular weight (Mn) and a mass average molecular weight (Mw) of the polyester resin. If a styrene acrylic resin is used as the binder resin, the styrene acrylic resin has a number average molecular weight (Mn) of preferably 2000 or more and 3000 or less. A molecular weight distribution (Mw/Mn) of the styrene acrylic resin is preferably 10 or more and 20 or less. The molecular weight distribution of the styrene acrylic resin is expressed as a ratio between the number average molecular weight (Mn) and the mass average molecular weight (Mw) of the styrene acrylic resin. The number average molecular weight (Mn) and the mass average molecular weight (Mw) of the binder resin can be measured by gel permeation chromatography.

[Coloring Agent]

The toner core may contain a coloring agent if necessary. As the coloring agent, any of known pigments or dyes can be used in accordance with the color of the toner particles. Specific examples of the coloring agent suitably used include the following:

An example of a black coloring agent includes carbon black. Alternatively, a coloring agent whose color is adjusted to black by using a plurality of types of coloring agents (such as a yellow coloring agent, a magenta coloring agent, and a cyan coloring agent described later) may be used as the black coloring agent.

If the toner is a color toner, examples of the coloring agent mixed in the toner core include a yellow coloring agent, a magenta coloring agent, and a cyan coloring agent.

Examples of the yellow coloring agent include condensed azo compounds, isoindolinone compounds, anthraquinone compounds, azo metal complexes, methine compounds and allylamide compounds. Specific examples of the yellow coloring agent include C.I. Pigment Yellow (3, 12, 13, 14, 15, 17, 62, 74, 83, 93, 94, 95, 97, 109, 110, 111, 120, 127, 128, 129, 147, 151, 154, 155, 168, 174, 175, 176, 180, 181, 191, or 194); and Naphthol Yellow S, Hansa Yellow G, and C.I. Bat Yellow.

Examples of the magenta coloring agent include condensed azo compounds, diketopyrrolopyrrole compounds, anthraquinone compounds, quinacridone compounds, basic dye lake compounds, naphthol compounds, benzimidazolone compounds, thioindigo compounds, and perylene compounds. A specific example of the magenta coloring agent includes C.I. Pigment Red (2, 3, 5, 6, 7, 19, 23, 48:2, 48:3, 48:4, 57:1 81:1, 122, 144, 146, 150, 166, 169, 177, 184, 185, 202, 206, 220, 221, or 254).

Examples of the cyan coloring agent include copper phthalocyanine compounds, copper phthalocyanine derivatives, anthraquinone compounds, and basic dye lake compounds. Specific examples of the cyan coloring agent include C.I. Pigment Blue (1, 7, 15, 15:1, 15:2, 15:3, 15:4, 60, 62, or 66); and phthalocyanine blue, C.I. Bat Blue, or C.I. Acid Blue.

The amount of the coloring agent to be used is preferably 1 part by mass or more and 20 parts by mass or less, and more preferably 3 parts by mass or more and 10 parts by mass or less based on 100 parts by mass of the binder resin.

[Release Agent]

The toner core may contain a release agent if necessary. The release agent is used generally for purpose of improving the fixability or the offset resistance of the toner.

Suitable examples of the release agent include aliphatic hydrocarbon waxes (such as low molecular weight polyethylene, low molecular weight polypropylene, polyolefin copolymers, polyolefin wax, microcrystalline wax, paraffin wax, and Fischer-Tropsch wax), oxides of the aliphatic hydrocarbon waxes (such as polyethylene oxide wax, and a block copolymer of polyethylene oxide wax), vegetable waxes (such as candelilla wax, carnauba wax, haze wax, jojoba wax, and rice wax), animal waxes (such as beeswax, lanolin, and spermaceti wax), mineral waxes (such as ozokerite, ceresin, and petrolatum), waxes containing a fatty acid ester as a principal component (such as montanic acid ester wax, and castor wax), and waxes obtained by deoxidizing part or whole of fatty acid ester (such as deoxidized carnauba wax).

The amount of the release agent to be used is preferably 1 part by mass or more and 30 parts by mass or less, and more preferably 5 parts by mass or more and 20 parts by mass or less based on 100 parts by mass of the binder resin.

[Charge Control Agent]

A charge control agent is used for purpose of improving the charge level or the charge rising property of a toner, which is an index whether or not the toner can be charged to prescribed charge level in a short period of time, so as to obtain a toner excellent in the durability or the stability. If development is performed with the toner positively charged, a positively chargeable charge control agent is preferably used. If the development is performed with the toner negatively charged, a negatively chargeable charge control agent is preferably used. If sufficient chargeability is secured in the toner, however, there is no need to use a charge control agent. For example, if a component having a charging function is contained in the shell layer, there is no need to add a charge control agent to the toner core.

Specific examples of the positively chargeable charge control agent include azine compounds (such as pyridazine, pyrimidine, pyrazine, ortho-oxazine, meta-oxazine, para-oxazine, ortho-thiazine, meta-thiazine, para-thiazine, 1,2,3-triazine, 1,2,4-triazine, 1,3,5-triazine, 1,2,4-oxadiazine, 1,3,4-oxadiazine, 1,2,6-oxadiazine, 1,3,4-thiadiazine, 1,3,5-thiadiazine, 1,2,3,4-tetrazine, 1,2,4,5-tetrazine, 1,2,3,5-tetrazine, 1,2,4,6-oxatriazine, 1,3,4,5-oxatriazine, phthalazine, quinazoline, and quinoxaline), direct dyes containing an azine compound (such as azine fast red FC, azine fast red 12BK, azine violet BO, azine brown 3G, azine light brown GR, azine dark green BH/C, azine deep black EW, and azine deep black 3RL), nigrosine compounds (such as nigrosine, nigrosine salts and nigrosine derivatives), acidic dyes containing a nigrosine compound (such as nigrosine BK, nigrosine NB, and nigrosine Z), metal salts of naphthenic acid, metal salts of higher fatty acid, alkoxylated amine, alkyl amide, and quaternary ammonium salts (such as benzyldecylhexylmethylammonium chloride and decyl trimethyl ammonium chloride). Among these positively chargeable charge control agents, nigrosine compounds are particularly preferably used because a rapider charge rising property can be attained by them. Two or more of these positively chargeable charge control agents may be used in combination.

A resin having a quaternary ammonium salt, a carboxylate, or a carboxyl group can be used as the positively chargeable charge control agent. Specific examples of such a resin include styrene resins having a quaternary ammonium salt, acrylic resins having a quaternary ammonium salt, styrene acrylic resins having a quaternary ammonium salt, polyester resins having a quaternary ammonium salt, styrene resins having a carboxylate, acrylic resins having a carboxylate, styrene acrylic resins having a carboxylate, polyester resins having a carboxylate, styrene resins having a carboxyl group, acrylic resins having a carboxyl group, styrene acrylic resins having a carboxyl group, and polyester resins having a carboxyl group. Such a resin may be an oligomer or a polymer.

Specific examples of the negatively chargeable charge control agent include organic metal complexes and chelate compounds. As the organic metal complexes and the chelate compounds, acetylacetone metal complexes (such as aluminum acetyl acetonate and iron (II) acetyl acetonate), salicylic acid metal complexes and salicylic acid metal salts (such as chromium 3,5-di-tert-butylsalicylate) are preferably used, and a salicylic acid metal complex or salicylic acid metal salt is more preferably used. Two or more of these negatively chargeable charge control agents may be used in combination.

The amount of the positively chargeable or negatively chargeable charge control agent to be used is preferably 0.5 part by mass or more and 20.0 parts by mass or less, more preferably 1.0 part by mass or more and 15.0 parts by mass or less assuming that the total mass of the toner is 100 parts by mass.

[Magnetic Powder]

The toner core may contain a magnetic powder in the binder resin if necessary. A toner containing toner particles produced by using such a toner core containing a magnetic powder is used as a magnetic one-component developer. Examples of a suitable material of the magnetic powder include iron (such as ferrite or magnetite), ferromagnetic metals (such as cobalt or nickel), alloys containing iron and/or a ferromagnetic metal, compounds containing iron and/or a ferromagnetic metal, ferromagnetic alloys having been ferromagnetized by heating or the like, and chromium dioxide.

The particle size of the magnetic powder is preferably 0.1 μm or more and 1.0 μm or less, and more preferably 0.1 μm or more and 0.5 μm or less. A magnetic powder having a particle size of 0.1 μm or more and 1.0 μm or less can be easily homogeneously dispersed in the binder resin.

The amount of the magnetic powder to be used in a toner working as a one-component developer is preferably 35 parts by mass or more and 60 parts by mass or less, and more preferably 40 parts by mass or more and 60 parts by mass or less assuming that the total amount of the toner is 100 parts by mass. Alternatively, the amount of the magnetic powder to be used in a toner contained in a two-component developer is preferably 20 parts by mass or less and more preferably 15 parts by mass or less assuming that the total amount of the toner is 100 parts by mass.

[Fine Particles]

The toner of the present disclosure contains fine particles having a charge property opposite to that of the toner in the interfacial portion between the toner core and the shell layer. Alternatively, the toner contains fine particles having a prescribed volume resistivity in the interfacial portion between the toner core and the shell layer. In the case where such fine particles are contained, the toner particles can be prevented from being excessively charged even if the toner particles are stirred in a developing unit for a long period of time in continuously forming images. The material of the fine particles is not especially limited as long as the resulting fine particles have the desired electrical property, and can be an inorganic material or an organic material.

The fine particles having a charge property opposite to that of the toner are negatively chargeable fine particles if the toner is positively chargeable. Examples of the negatively chargeable fine particles include negatively chargeable silica fine particles, titanium oxide fine particles, alumina fine particles, or acrylic resin beads. The negatively chargeable fine particles are preferably negatively chargeable silica fine particles. Fine particles not having a negative charge property can be made negatively chargeable by a surface treatment with a surface treatment agent (such as a silane coupling agent).

The fine particles having a charge property opposite to that of the toner are positively chargeable fine particles if the toner is negatively chargeable. Examples of the positively chargeable fine particles include fine particles of silica, titanium oxide, or alumina with surfaces having been subjected to a positively charging treatment with a nitrogen-containing silane coupling agent, such as γ-amino triethoxysilane, N-β (aminoethyl) γ-aminopropyl methyl dimethoxysilane, N-β (aminoethyl) γ-aminopropyl trimethoxysilane, N-β(aminoethyl) γ-aminopropyl triethoxysilane, γ-aminopropyl trimethoxysilane, γ-aminopropyl triethoxysilane, or N-phenyl-γ-aminopropyl trimethoxysilane. Fine particles not having a positive charge property can be made positively chargeable by a surface treatment with a surface treatment agent (such as a nitrogen-containing silane coupling agent).

If the fine particles have a volume resistivity lower than those of both the binder resin and the shell layer, suitable examples of the fine particles include titanium oxide fine particles, tin oxide fine particles, silicon carbide fine particles, zinc oxide fine particles, strontium titanate fine particles, and carbon black fine particles. The volume resistivity of the fine particles is not especially limited as long as it is lower than the volume resistivity of the binder resin and the volume resistivity of the shell layer, and is preferably $10^5$ Ω·cm or more and $10^{10}$ Ω·cm or less, and more preferably $10^7$ Ω·cm or more and $10^{10}$ Ω·cm or less. The volume resistivity of the binder resin and the volume resistivity of the shell layer are not especially limited as long as they are higher than the volume resistivity of the fine particles, and the volume resistivity of the binder resin is preferably $10^{10}$ Ω·cm or more. The volume resistivity of the shell layer is preferably $10^{14}$ Ω·cm or more.

The particle size of the fine particles contained in the interfacial portion between the tore core and the shell layer is not especially limited as long as the coating of the surface of the toner core with the shell layer is not inhibited. The particle size of the fine particles is, in terms of the volume average particle size, preferably 5 nm or more and 150 nm or less, and more preferably 10 nm or more and 100 nm or less.

The amount of the fine particles contained in the interfacial portion between the toner core and the shell layer is varied depending upon the average particle size of the toner core, and if the volume average particle size of the toner core is 7.0 μm, the amount of the fine particles is preferably 0.2% by mass or more and 2.0% by mass or less, and more preferably 0.5% by mass or more and 1.5% by mass or less based on the total mass of the toner core.

[Resin Constituting Shell Layer]

The resin constituting the shell layer contains the unit derived from the monomer of the thermosetting resin and the unit derived from the thermoplastic resin. It is noted that the unit derived from the monomer of the thermosetting resin means, in the present application and the appended claims, a unit obtained by introducing a methylene group (—$CH_2$—) derived from formaldehyde into a monomer such as melamine.

The resin constituting the shell layer is formed through a reaction between the monomer of the thermosetting resin and the thermoplastic resin. The unit derived from the thermoplastic resin is crosslinked by the unit derived from the monomer of the thermosetting resin. Therefore, the shell layer of the toner of the present embodiment has suitable flexibility owing to the unit derived from the thermoplastic resin as well as suitable mechanical strength owing to a three-dimensional crosslinked structure formed by the monomer of the thermosetting resin. Accordingly, the shell layer of the toner of the present embodiment is not easily broken during storage or transportation. On the other hand, the shell layer of the present embodiment is easily broken by applying heat and pressure in fixing the toner. For these reasons, the toner of the present embodiment is excellent in the high-temperature preservability and the low-temperature fixability even if the shell layer is thin. Now, materials suitably used for forming the resin constituting the shell layer (i.e., examples of the monomer of the thermosetting resin, and the thermoplastic resin) will be described.

(Monomer of Thermosetting Resin)

A monomer or a prepolymer used for introducing the unit derived from the monomer of the thermosetting resin into the resin constituting the shell layer is one or more monomers selected from the group of amino resins consisting of a melamine resin, a urea resin, and a glyoxal resin, of an initial condensation product thereof.

The melamine resin is a polycondensate of melamine and formaldehyde. A monomer used for forming the melamine resin is melamine. The urea resin is a polycondensate of urea and formaldehyde. A monomer used for forming the urea resin is urea. The glyoxal resin is a polycondensate of a reactant between glyoxal and urea, and formaldehyde. A monomer used for forming the glyoxal resin is a reactant between glyoxal and urea. Each of the melamine used for forming the melamine resin, the urea used for forming the urea resin, and the urea to be reacted with glyoxal may be modified by a known method. The monomer of the thermosetting resin may be methylolated (derivatized) by formaldehyde before reacting with the thermoplastic resin.

The shell layer of the toner of the present embodiment contains a nitrogen atom derived from melamine or urea. Therefore, the toner of the present embodiment having the shell layer containing the nitrogen atom can be easily positively charged. Therefore, if the toner of the present embodiment is positively charged to form an image, toner particles contained in the toner can be easily positively charged to have a desired charge amount. In order to positively charge the toner particles contained in the toner to have a desired charge amount, the content of the nitrogen atom in the shell layer is preferably 10% by mass or more.

(Thermoplastic Resin)

The thermoplastic resin used for introducing the unit derived from the thermoplastic resin into the resin constituting the shell layer is preferably a thermoplastic resin having a functional group reactive with a functional group (such as a methylol group or an amino group) of the aforementioned monomer of the thermosetting resin. Examples of the functional group reactive with a methylol group or an amino group include functional groups including an active hydrogen atom (such as a hydroxyl group, a carboxyl group, and an amino group). An amino group may be contained in the thermoplastic resin in the form of a carbamoyl group (—$CONH_2$). The thermoplastic resin is preferably a resin containing a unit derived from (meth)acrylamide, or a resin containing a unit derived from a monomer having a functional group such as a carbodiimide group, an oxazoline group, or a glycidyl group because the shell layer can be easily formed when such a resin is used.

Specific examples of the thermoplastic resin used for forming the shell layer include (meth)acrylic resins, styrene-(meth)acrylic copolymer resins, silicone-(meth)acrylic graft copolymers, polyurethane resins, polyester resins, polyvinyl alcohols, and ethylene vinyl alcohol copolymers. Such resins may contain a unit derived from a monomer having a functional group such as a carbodiimide group, an oxazoline group, or a glycidyl group. Among these resins, the thermoplastic resin is preferably a (meth)acrylic resin, a styrene-(meth)acrylic copolymer resin, or a silicone-(meth)acrylic graft copolymer, and is more preferably a (meth)acrylic resin.

Examples of a (meth)acrylic monomer usable for preparing the (meth)acrylic resins include (meth)acrylic acid, alkyl ester (meth)acrylate (such as methyl (meth)acrylate, ethyl (meth)acrylate, n-propyl (meth)acrylate, or n-butyl (meth) acrylate), aryl ester (meth)acrylate (such as phenyl (meth) acrylate), hydroxyalkyl ester (meth)acrylate (such as 2-hydroxyethyl (meth)acrylate, 3-hydroxypropyl (meth)acrylate, 2-hydroxypropyl (meth)acrylate, or 4-hydroxybutyl (meth) acrylate), (meth)acrylamide, an ethylene oxide adduct of (meth)acrylic acid, and alkyl ether (such as methyl ether, ethyl ether, n-propyl ether, or n-butyl ether of an ethylene oxide adduct of (meth)acrylic ester).

The shell layer is formed preferably in an aqueous medium. Thus, elution of a release agent component contained in the toner core, or dissolution of the binder resin can be suppressed. The thermoplastic resin used for forming the shell layer is preferably water-soluble. An aqueous solution of the thermoplastic resin is preferably used for forming the shell layer.

A ratio (Ws/Wp), in the resin constituting the shell layer, of a content (Ws) of the unit derived from the monomer of the thermosetting resin to a content (Wp) of the unit derived from the thermoplastic resin is preferably 3/7 or more and 8/2 or less, and more preferably 4/6 or more and 7/3 or less.

The thickness of the shell layer is preferably 1 nm or more and 20 nm or less, and more preferably 1 nm or more and 10 nm or less. If an image is formed by using a toner containing toner particles having a too thick shell layer, the shell layer is difficult to break in fixing the toner onto a recording medium even if a pressure is applied to the toner particles. Furthermore, the binder resin and the release agent contained in the toner core are not rapidly softened and molten, and hence, the toner is difficult to fix on a recording medium in a low temperature region. On the other hand, if the shell layer is too thin, the strength of the shell layer is low. If the strength of the shell layer is low, the shell layer may be broken by impact caused in a situation of transportation or the like. Besides, if the toner is stored at a high temperature, toner particles having a shell layer at least partly broken are easily aggregated. This is because a component of the release agent or the like can easily exude onto the surface of the toner particle through a broken portion of the shell layer.

The thickness of the shell layer can be measured by analyzing a TEM image of the cross-section of the toner particle by using commercially available image analysis software. As the commercially available image analysis software, for example, WinROOF (manufactured by Mitani Corporation) can be used. Specifically, two straight lines are drawn to cross at substantially the center of the cross-section of a toner particle, and the lengths of four sections of the two straight lines crossing the shell layer are measured. An average of the thus measured lengths of the four sections is defined as the thickness of the shell layer of one toner particle to be measured. This measurement of the thickness of the shell layer is performed on ten or more toner particles, so as to obtain an average of the thicknesses of the shell layers of the plural toner particles to be measured. The thus obtained average is determined as the thickness of the shell layer of the toner particles.

If the shell layer is too thin, it may be difficult to measure the thickness of the shell layer because the interface between the shell layer and the toner core is unclear on a TEM image. In such a case, a TEM image capture may be combined with energy dispersive X-ray spectroscopic analysis (EDX). Specifically, an element characteristic to the material of the shell layer (such as nitrogen) is mapped on the TEM image, so as to make clear the interface between the shell layer and the toner core, and thus, the thickness of the shell layer can be easily measured.

The thickness of the shell layer may be adjusted by adjusting the amounts of the materials to be used for forming the shell layer (such as the monomer of the thermosetting resin, and the thermoplastic resin). The thickness of the shell layer can be presumed, for example, based on the specific surface area of the toner core, the amount of the monomer of the thermosetting resin and the amount of the thermoplastic resin in accordance with the following formula:

Thickness of shell layer=(amount of monomer of thermosetting resin+amount of thermoplastic resin)/specific surface area of toner core If fine particles having the volume resistivity lower than those of both the binder resin and the shell layer are to be used, it is necessary to measure the volume resistivity of the shell layer for selecting suitable fine particles. In this case, it is difficult to measure the volume resistivity of the shell layer itself. However, the volume resistivity of the shell layer can be measured by the following method: In an arbitrary preferable solvent, a monomer of a thermosetting resin and a thermoplastic resin of the same types and amounts as those used for forming the toner particles are reacted with each other. Thus, a resin of the same material as the shell layer is obtained. The volume resistivity of the shell layer can be measured by measuring the volume resistivity of the thus obtained resin.

[External Additive]

In the toner of the present embodiment, an external additive may be adhered to the surface of the toner particle as occasion demands. It is noted that toner particles obtained prior to a treatment with the external additive are sometimes designated as toner mother particles in the present application and the appended claims.

Examples of the external additive include silica and a metal oxide (such as alumina, titanium oxide, magnesium oxide, zinc oxide, strontium titanate, or barium titanate).

The external additive has a particle size of preferably 0.01 μm or more and 1.0 μm or less.

The amount of the external additive to be used is preferably 1 part by mass or more and 10 parts by mass or less, and more preferably 2 parts by mass or more and 5 parts by mass or less based on 100 parts by mass of toner mother particles.

[Carrier]

The toner can be mixed with a desired carrier to be used as a two-component developer. In preparing a two-component developer, a magnetic carrier is preferably used.

An example of a suitable carrier includes one obtained by coating a carrier core with a resin. Specific examples of the carrier core include a particle of a material such as iron, oxidized iron, reduced iron, magnetite, copper, silicon steel, ferrite, nickel, or cobalt, or a particle of an alloy of such a material and manganese, zinc, or aluminum; a particle of an iron-nickel alloy or an iron-cobalt alloy; a particle of a ceramic such as titanium oxide, aluminum oxide, copper oxide, magnesium oxide, lead oxide, zirconium oxide, silicon carbide, magnesium titanate, barium titanate, lithium titanate, lead titanate, lead zirconate, or lithium niobate; and a particle of a high-dielectric constant material such as ammonium dihydrogen phosphate, potassium dihydrogen phosphate, or Rochelle salt. A resin carrier containing any of these particles (magnetic particles) dispersed in a resin may be used as a carrier.

Specific examples of the resin coating the carrier core include (meth)acrylic polymers, styrene polymers, styrene-(meth)acrylic copolymers, olefin polymers (such as polyethylene, chlorinated polyethylene, and polypropylene), polyvinyl chloride, polyvinyl acetate, polycarbonate, cellulose resins, polyester resins, unsaturated polyester resins, polyamide resins, polyurethane resins, epoxy resins, silicone resins, fluorine resins (such as polytetrafluoroethylene, polychlorotrifluoroethylene, and polyvinylidene fluoride), phenol resins, xylene resins, diallyl phthalate resins, polyacetal resins, and amino resins. Two or more of these resins may be used in combination.

The carrier has a particle size, measured by using an electron microscope, of preferably 20 μm or more and 120 μm or less, and more preferably 25 μm or more and 80 μm or less.

If the toner is used in a two-component developer, the content of the toner in the two-component developer is preferably 3% by mass or more and 20% by mass or less, and more preferably 5% by mass or more and 15% by mass or less based on the total mass of the two-component developer.

As a method for producing the toner, a method in which the toner core can be coated with the shell layer of any of the aforementioned prescribed materials so that the fine particles having the charge property opposite to that of the toner or having the prescribed volume resistivity can be contained in an interfacial portion between the toner core and the shell layer is preferably employed. Now, a method for producing the toner core, a method for surface-treating the toner core with the prescribed fine particles, and a method for forming the shell layer employed in a suitable method for producing the electrostatic latent image developing toner of the present embodiment will be successively described.

[Method for Producing Toner Core]

As a method for producing the toner core, a method in which the components such as a coloring agent, a charge control agent, a release agent, and a magnetic powder can be satisfactorily dispersed in the binder resin is preferably employed.

For preparing the toner of the present disclosure, the surface of toner core is treated with the aforementioned prescribed fine particles, and then, the thus treated surface of the toner core is coated with the shell layer. The toner core having been surface-treated with the prescribed fine particles preferably shows a frictional charge property described below.

Specifically, a frictional charge amount of the toner core attained when a standard carrier and the toner core having the fine particles adhered onto the surface thereof in a ratio of 7% by mass based on the standard carrier are mixed for 30 minutes by using a Turbula mixer is preferably −20 μC/g or more and −5 μC/g or less. A specific method for measuring the frictional charge amount will now be described.

<Method for Measuring Frictional Charge Amount>

A standard carrier N-01 (a standard carrier for a negatively chargeable toner) available from The Imaging Society of Japan, and the toner core having been surface-treated with the fine particles are mixed by using a Turbula mixer for 30 minutes. Here, the amount of the toner core to be used is 7% by mass based on the mass of the standard carrier. After mixing, the frictional charge amount of the toner core having been surface-treated with the fine particles is measured by using a QM meter ("MODEL 210HS-2A" manufactured by TREK Inc.). The frictional charge amount of the toner core having been surface-treated with the fine particles thus measured is used as an index for determining how easily the toner core can be charged (or which of the positive polarity and the negative polarity the toner core can be easily charged to).

In the case where a uniform shell layer is formed on the surface of the toner core having been surface-treated with the fine particles, it is generally necessary to highly disperse the toner cores in an aqueous medium containing a dispersant. If the toner core having been surface-treated with the fine particles shows the aforementioned frictional charge property, however, the toner core having been surface-treated with the fine particles is easily negatively charged because the toner core is stirred in the aqueous medium. Therefore, the toner core having been surface-treated with the negatively charged fine particles and the monomer of the thermosetting resin (such as a nitrogen-containing compound) positively charged in the aqueous medium are electrically attracted to each other. Then, on the surface of the toner core having been surface-treated with the fine particles, the reaction between the monomer of the thermosetting resin having been adsorbed onto the toner core and the thermoplastic resin is satisfactorily proceeded. Accordingly, if the shell layer is to be formed on the surface of the toner core by using the toner core negatively charged in an aqueous medium, the shell layer can be formed on the surface of the toner core without highly dispersing the toner cores in the aqueous medium by using a dispersant.

If a toner is produced by using the toner core having been surface-treated with the fine particles and having a prescribed range of the frictional charge amount obtained by friction with the standard carrier and measured under the aforementioned specific condition, it is regarded that a toner particle containing a tore core coated with a shell layer can be easily obtained without using a dispersant as described above. Besides, if the toner is produced without using a dispersant, which causes extremely high drainage load, the concentration of total organic carbon in a drainage can be probably suppressed to a low level (of, for example, 15 mg/L or less) without diluting a drainage discharged during the production of the toner.

A method for producing the toner core (a melt kneading method or an aggregation method) will now be described. The toner core can be prepared more easily by the melt kneading method than by the aggregation method. A toner core with high sphericity can be more easily produced by the aggregation method than by the melt kneading method. A toner core having uniform shape and particle size can be more easily produced by the aggregation method.

<Melt Kneading Method (Pulverization Method)>

The melt kneading method (pulverization method) includes: kneading materials contained in a toner particle or a toner core; pulverizing the resulting kneaded product; and classifying the resulting pulverized product. In the melt kneading method, a binder resin and an arbitrary component to be added if necessary (such as a coloring agent, a release agent, a charge control agent, or a magnetic powder) are mixed. Subsequently, the resulting mixture is melt kneaded. Thereafter, the resulting melt kneaded product is pulverized and classified. Thus, a toner core having a desired particle size can be obtained.

<Aggregation Method>

The aggregation method preferably includes an aggregation process and a coalescence process described below. In the aggregation process, fine particles containing components of the toner core are aggregated in an aqueous medium to form aggregated particles. In the coalescence process, components contained in the aggregated particles are coalesced in an aqueous medium to form a toner core.

[Aggregation Process]

In the aggregation process, fine particles containing components of the toner core (hereinafter referred to as the core fine particles) are used. The core fine particles may contain, in addition to the binder resin, an arbitrary component (such as a coloring gent, a release agent, or a charge control agent).

An aqueous dispersion containing the core fine particles can be prepared, for example, by micronizing a binder resin (or a composition containing a binder resin) to a desired size in an aqueous medium. The aqueous dispersion containing the core fine particles may contain other fine particles apart from the fine particles containing the binder resin. Examples of the other fine particles include fine particles of a coloring agent, fine particles of a release agent, and fine particles containing a coloring agent and a release agent. Now, a method for preparing the fine particles containing a binder resin, a method for preparing the fine particles of a coloring agent, and a method for preparing the fine particles of a release agent will be successively described.

(Method for Preparing Fine Particles Containing Binder Resin)

A suitable example of the method for preparing fine particles containing a binder resin will now be described.

A resin composition containing a binder resin and an arbitrary component added if necessary is primarily pulverized by using a pulverizer such as a turbo mill. The resulting primarily pulverized product is dispersed in an aqueous medium such as ion-exchanged water, and in this state, it is heated to a temperature equal to or higher, by 10° C. or more, than the softening point ($Tm_r$) of the binder resin measured by using a flow tester ($Tm_r$+10° C.) and equal to or lower than 200° C. Subsequently, to the thus heated dispersion of the binder resin, a strong shearing force is applied by using a high-speed shearing emulsifier (such as Clearmix (manufactured by M Technique Co., Ltd.)). In this manner, an aqueous dispersion including fine particles containing the binder resin (hereinafter referred to as the resin dispersion) can be obtained.

The volume average particle size ($D_{50}$) of the fine particles containing the binder resin is preferably 1 μm or less, and more preferably 0.05 μm or more and 0.5 μm or less. If the fine particles containing the binder resin have a particle size ($D_{50}$) of 1 μm or less, toner cores having a sharp particle size distribution and having a uniform shape can be easily obtained. The volume average particle size ($D_{50}$) of the fine particles containing the binder resin can be measured by using a laser diffraction particle size analyzer (such as "SALD-2200" (manufactured by Shimadzu Corporation)).

The resin dispersion preferably contains a surfactant. If the resin dispersion contains a surfactant, the fine particles containing the binder resin can be easily stably dispersed in the aqueous medium.

The surfactant that may be contained in the resin dispersion can be appropriately selected from the group consisting of an anionic surfactant, a cationic surfactant, and a nonionic surfactant. Examples of the anionic surfactant include a sulfuric acid ester salt type surfactant, a sulfonic acid salt type surfactant, a phosphoric acid ester salt type surfactant, and soap. Examples of the cationic surfactant include an amine salt type surfactant and a quaternary ammonium salt type surfactant. Examples of the nonionic surfactant include a polyethylene glycol type surfactant, an alkylphenol ethylene oxide adduct type surfactant, and a polyvalent alcohol type surfactant containing a derivative of a polyvalent alcohol (such as glycerin, sorbitol, or sorbitan). Among these surfactants, an anionic surfactant is preferably used. One of the aforementioned surfactants may be singly used, or two or more of these may be used in combination.

The amount of the surfactant to be used is preferably 0.01% by mass or more and 10% by mass or less based on the total mass of the binder resin.

In using a resin having an acidic group as the binder resin, if the binder resin is directly micronized in an aqueous medium, the specific surface area of the binder resin may be so increased that the pH of the aqueous medium may be lowered to approximately 3 to 4 due to the influence of the acidic group exposed on the surface of the fine particles containing the binder resin. In the aqueous medium having pH of approximately 3 to 4, the binder resin may be hydrolyzed, or the fine particles containing the binder resin cannot be micronized to a desired particle size.

In order to suppress the aforementioned problem derived from the acidic group, a basic substance may be added to the aqueous medium in preparing the fine particles containing the binder resin. Examples of the basic substance include alkali metal hydroxide (such as sodium hydroxide, potassium hydroxide, or lithium hydroxide), alkali metal carbonate (such as sodium carbonate or potassium carbonate), alkali metal hydrogencarbonate (such as sodium hydrogencarbonate or potassium hydrogencarbonate), and a nitrogen-containing organic base (such as N,N-dimethylethanolamine, N,N-diethylethanolamine, triethanolamine, tripropanolamine, tributanolamine, triethylamine, n-propylamine, n-butylamine, isopropylamine, monomethanolamine, morpholine, methoxypropylamine, pyridine, or vinylpyridine).

(Method for Preparing Fine Particles of Release Agent)

An example of the method for preparing fine particles of a release agent will now be described.

A release agent is precedently pulverized into a size of approximately 100 μm or less to obtain a powder of the release agent. For preparing the fine particles of the release agent, a slurry is preferably prepared by adding the powder of the release agent to an aqueous medium containing a surfactant. The amount of the surfactant to be used is preferably 0.01% by mass or more and 10% by mass or less based on the total mass of the release agent.

Next, the thus obtained slurry is heated to a temperature beyond the melting point of the release agent. Subsequently, a strong shearing force is applied to the heated slurry by using a homogenizer ("Ultra-Turrax T50" manufactured by IKA) or a pressure-ejecting type disperser, so as to prepare an aqueous dispersion containing release agent fine particles (hereinafter referred to as the release dispersion). An apparatus for applying a strong shearing force to the dispersion is, for example, NANO3000 (manufactured by Beryu Co., Ltd.), Nanomizer (manufactured by Yoshida Kikai Co., Ltd.), Microfluidizer (manufactured by MFI), Gaulin Homogenizer (manufactured by Manton Gaulin), or Clearmix W Motion (manufactured by M Technique Co., Ltd.).

The volume average particle size ($D_{50}$) of the fine particles of the release agent contained in the release dispersion is preferably 1 μm or less, more preferably 0.1 μm or more and 0.7 μm or less, and particularly preferably 0.28 μm or more and 0.55 μm or less. If fine particles of the release agent having a particle size ($D_{50}$) of 1 μm or less are used, a toner particle in which the release agent is homogeneously dispersed in the binder resin can be easily obtained. The volume average particle size ($D_{50}$) of the fine particles of the release agent can be measured by a similar method to the measurement method for the volume average particle size ($D_{50}$) of the fine particles containing the binder resin.

(Method for Preparing Fine Particles of Coloring Agent)

A suitable example of the method for preparing fine particles of a coloring agent will now be described.

An aqueous dispersion containing fine particles of a coloring agent (hereinafter referred to as the coloring dispersion) is preferably prepared by dispersing, by using a known disperser, the coloring agent and an arbitrary component such as a dispersant for the coloring agent to be added if necessary in an aqueous medium containing a surfactant. As the surfactant, the same surfactant as that used in preparing the fine particles containing the binder resin can be used. The amount of the surfactant to be used is preferably 0.01% by mass or more and 10% by mass or less based on the total mass of the coloring agent.

The disperser used for the dispersion of the coloring agent is not especially limited, and for example, an ultrasonic disperser, a pressure disperser (such as a mechanical homogenizer, Manton Gaulin, a pressure homogenizer, or a high-pressure homogenizer (manufactured by Yoshida Kikai Co., Ltd.)), or a medium type disperser (such as a sand grinder, a horizontal bead mill, a vertical bead mill, Ultra Apex Mill (manufactured by Kotobuki Industries Co., Ltd.), Dyno Mill (manufactured by WAB Company), or MSC mill (manufactured by Nippon Coke and Engineering Co., Ltd.)) can be used.

The volume average particle size ($D_{50}$) of the fine particles of the coloring agent is preferably 0.01 μm or more and 0.2 μm or less. The volume average particle size ($D_{50}$) of the fine particles of the coloring agent can be measured by a method similar to the measurement method employed for the volume average particle size ($D_{50}$) of the fine particles containing the binder resin.

(Formation of Aggregated Particles)

The resin dispersion prepared by the aforementioned method is combined with the release dispersion and/or the coloring dispersion as occasion demands (for example, so that desired components can be contained in the toner core), and thereafter, the fine particles are aggregated, and thus, an aqueous dispersion including aggregated particles containing the binder resin (hereinafter referred to as the aggregation dispersion) can be obtained.

As a suitable method for aggregating the fine particles, an aggregating agent is added to the resin dispersion after adjusting the pH of the resin dispersion, and then, the temperature of the resin dispersion is adjusted to a prescribed temperature for aggregating the fine particles.

Suitable examples of the aggregating agent include an inorganic metal salt, an inorganic ammonium salt, and a bivalent or higher valent metal complex. Examples of the inorganic metal salt include a metal salt (such as sodium sulfate, sodium chloride, calcium chloride, calcium nitrate, barium chloride, magnesium chloride, zinc chloride, aluminum chloride, or aluminum sulfate), and an inorganic metal salt polymer (such as polyaluminum chloride or polyaluminum hydroxide). Examples of the inorganic aluminum salt include ammonium sulfate, ammonium chloride, and ammonium nitrate. Alternatively, a quaternary ammonium salt type cationic surfactant, or a nitrogen-containing compound such as polyethyleneimine can be used as the aggregating agent.

As the aggregating agent, a bivalent metal salt, or a monovalent metal salt is preferably used. One of these aggregating agents may be singly used, or two or more of them may be used in combination. If two or more of the aggregating agents are used in combination, a bivalent metal salt and a monovalent metal salt are preferably used together. A bivalent metal salt and a monovalent metal salt are different in the speed of aggregating fine particles. Therefore, when they are used together, a particle size distribution of the aggregated particles can be easily made sharp while suppressing increase of the particle size of the resulting aggregated particles.

The aggregating agent is added preferably after adjusting the pH of the dispersion of the fine particles. The aqueous dispersion has pH of preferably 8 or more in adding the aggregating agent. The aggregating agent may be added at one time or gradually added.

The amount of the aggregating agent to be added is preferably 1 part by mass or more and 50 parts by mass or less based on 100 parts by mass of a solid content of the aqueous dispersion. The amount of the aggregating agent to be added is preferably appropriately adjusted in accordance with the type and the amount of dispersant (an anionic dispersant or a nonionic dispersant) contained in the dispersion of the fine particles.

The temperature of the aqueous dispersion at which the fine particles are aggregated is preferably equal to or higher than the glass transition point (Tg) of the binder resin and lower than a temperature beyond the glass transition point (Tg) of the binder resin by 10° C. When the aqueous dispersion containing the fine particles of the binder resin is heated to such a temperature, the aggregation of the fine particles contained in the aqueous dispersion can be satisfactorily proceeded.

After the aggregation is proceeded until the aggregated particles attain a desired particle size, an aggregation terminator may be added. Examples of the aggregation terminator include sodium chloride, potassium chloride, and magnesium chloride.

[Coalescence Process]

In the coalescence process, the aggregation dispersion obtained as described above is heated to coalesce the components contained in the aggregated particles. In this manner, an aqueous dispersion containing a toner core having a desired particle size can be obtained. The temperature to which the aggregation dispersion is heated is preferably equal to or higher than a temperature beyond the glass transition point (Tg) of the binder resin by 10° C., and equal to or lower than the melting point of the binder resin. When the aggregation dispersion is heated to such a temperature, the coalescence of the components contained in the aggregated particles can be satisfactorily proceeded.

[Washing Process for Toner Core]

In a washing process, the toner core obtained as described above is washed with water. As an exemplified washing method, toner cores are collected as a wet cake by solid-liquid separating the toner cores from the toner core aqueous dispersion, and the resulting wet cake is washed with water. Alternatively, the toner cores contained in the toner core aqueous dispersion are precipitated, the supernatant is exchanged with water, and the toner cores are dispersed again in water after the exchange.

[Drying Process for Toner Core]

As a suitable method for drying the toner core, a dryer (such as a spray dryer, a fluidized-bed dryer, a vacuum freeze dryer, or a vacuum dryer) is used.

[Surface Treatment Method for Toner Core Using Fine Particles]

Each of the toner particles contained in the toner of the present disclosure contains the prescribed fine particles (i.e., the fine particles having a charge property opposite to that of the toner, or the fine particles having the prescribed volume resistivity) in the interfacial portion between the toner core and the shell layer. Therefore, before forming the shell layer, the surface of the toner core is treated with the prescribed fine particles. The toner containing toner particles each including the prescribed fine particles in the interfacial portion between the toner core and the shell layer can be obtained by forming the shell layer on the surface of the toner core having been surface-treated with the prescribed fine particles.

A method for treating the surface of the toner core with the prescribed fine particles is not especially limited as long as a sufficient amount of prescribed fine particles can be adhered onto the surface of the toner core. Specifically, the toner cores and the prescribed fine particles are mixed by using a mixer (such as a Henschel mixer or a Nauta mixer) under conditions adjusted so that the prescribed fine particles cannot be buried too much in a surface portion of the toner core. Thus, the surface of the toner core can be treated with the prescribed fine particles.

[Method for Forming Shell Layer]

The shell layer coating the toner core can be formed by causing a reaction between the monomer of the thermosetting resin (melamine, urea, or a reactant between glyoxal and urea) and the thermoplastic resin. Alternatively, instead of the monomer of the thermosetting resin, a precursor (a methylolated product) generated through an addition reaction of the monomer of the thermosetting resin and formaldehyde may be used. Incidentally, in order to prevent dissolution of the binder resin or exudation of the release agent contained in the toner core into a solvent used for forming the shell layer, the shell layer is preferably formed in an aqueous medium such as water.

The shell layer is formed preferably by adding materials for forming the shell layer to the aqueous dispersion containing the toner core. Examples of a method for satisfactorily dispersing toner cores in an aqueous medium include a method in which the toner cores are mechanically dispersed in the aqueous medium by using an apparatus capable of powerfully stirring a dispersion (hereinafter referred to as the first dispersion method), and a method in which the toner cores are dispersed in an aqueous medium containing a dispersant (hereinafter referred to as the second dispersion method). In the second dispersion method, the toner cores are homogeneously dispersed in the aqueous medium. Therefore, a uniform shell layer can be easily formed by the second dispersion method. On the other hand, total organic carbon in drainage can be reduced in the first dispersion method.

A suitable example of the stirrer used in the first dispersion method includes HIVIS MIX (manufactured by Primix Corporation).

Suitable examples of the dispersant used in the second dispersion method include compounds such as sodium polyacrylate, poly(paravinylphenol), partially saponificated polyvinyl acetate, isoprene sulfonic acid, polyether, an isobutylene/maleic anhydride copolymer, sodium polyaspartate, starch, gelatin, acacia gum, polyvinyl pyrrolidone, and sodium lignosulfonate. One of these dispersants may be singly used, or two or more of them may be used in combination.

The amount of the dispersant to be used is preferably 75 parts by mass or less based on 100 parts by mass of the toner core.

In the second dispersion method using a dispersant, the toner cores are highly dispersed in the medium used for forming the shell layer as described above. Therefore, the toner core can be easily uniformly coated by the shell layer. On the contrary, since the toner cores are dispersed by using the dispersant, the dispersant may be adhered to the surface of the toner core before forming the shell layer thereon. If the shell layer is formed with the dispersant present on the interface between the toner core and the shell layer, the adhesion of the shell layer to the toner core is weakened, and hence, there is a tendency that the shell layer is likely to be peeled off from the toner core by mechanical stress applied to the toner.

The pH of the aqueous dispersion containing the toner core is preferably adjusted to approximately 4 by using an acidic substance before forming the shell layer. By adjusting the pH of the dispersion to be on the acidic side, condensation polymerization of the materials used for forming the shell layer described later can be accelerated.

After adjusting the pH of the aqueous dispersion containing the toner core, the materials used for forming the shell layer may be dissolved in the aqueous dispersion containing the toner core as occasion demands. Thereafter, the reaction between the materials for forming the shell layer is proceeded on the surface of the toner core in the aqueous dispersion, so that the shell layer coating the surface of the toner core can be formed.

The temperature at which the shell layer is formed by causing the reaction between the monomer of the thermosetting resin and the thermoplastic resin is preferably 40° C. or more and 95° C. or less, and more preferably 50° C. or more and 80° C. or less. If the shell layer is formed at a temperature of 40° C. or more and 95° C. or less, the formation of the shell layer can be satisfactorily proceeded.

In the case where the binder resin contains a resin having a hydroxyl group or a carboxyl group (such as a polyester resin), if the shell layer is formed at a temperature of 40° C. or more and 95° C. or less, there is a tendency that the hydroxyl group or the carboxyl group exposed on the surface of the toner core is reacted with the methylol group of the monomer of the thermosetting resin to form a covalent bond between the binder resin contained in the toner core and the resin constituting the shell layer. As a result, the shell layer is easily firmly adhered to the toner core.

After forming the shell layer as described above, the aqueous dispersion containing the toner core coated with the shell layer is cooled to room temperature, and thus, a dispersion of toner mother particles can be obtained. Thereafter, after one or more processes selected from a washing process for washing the toner mother particles, a drying process for drying the toner mother particles, and an external addition process for adhering an external additive to the surfaces of the toner mother particles if necessary, a toner is collected from the dispersion of the toner mother particles. The washing process, the drying process, and the external addition process will now be described. It is noted that any of the washing process, the drying process, and the external addition process may be appropriately omitted.

[Washing Process for Toner Mother Particles]

The toner mother particles are washed with water if necessary. As a suitable example of a method for washing the toner mother particles, the toner mother particles are collected as a wet cake by solid-liquid separating the toner mother particles from the aqueous medium containing the toner mother particles, and the obtained wet cake is washed with water. As another suitable example of the method for washing the toner mother particles, the toner mother particles are precipitated in the dispersion containing the toner mother particles, the supernatant is exchanged with water, and the toner mother particles are dispersed again in water after the exchange.

[Drying Process for Toner Mother Particles]

The toner mother particles may be dried if necessary. As a suitable method for drying the toner mother particles, a dryer (such as a spray dryer, a fluidized-bed dryer, a vacuum freeze dryer, or a vacuum dryer) is used. A spray dryer is more preferably used for suppressing the aggregation of the toner mother particles during the drying process. If a spray dryer is used, an external additive such as silica may be adhered to the surfaces of the toner mother particles by spraying, together with the dispersion of the toner mother particles, a dispersion of the external additive.

[External Addition Process for Toner Mother Particles]

An external additive may be adhered to the surfaces of the toner mother particles obtained as described above if necessary. As a suitable example of a method for adhering an external additive to the surfaces of the toner mother particles, the toner mother particles and the external additive are mixed by using a mixer such as a Henschel mixer or a Nauta mixer under conditions where the external additive is not buried in a surface portion of the toner mother particle. By adhering the external additive to the surfaces of the toner mother particles, the toner particles are obtained. Incidentally, if no external additive is adhered to the surfaces of the toner mother particles (namely, the external addition process is omitted), the toner mother particles correspond to the toner particles.

In the electrostatic latent image developing toner of the present embodiment described so far, excessive charging of the toner particles can be suppressed even if the toner particles are stirred for a long period of time in a developing unit, and the high-temperature preservability and the low-temperature fixability are excellent. Accordingly, the electrostatic latent image developing toner of the present embodiment can be suitably used in a variety of image forming apparatuses.

EXAMPLES

Examples of the present disclosure will now be described. It is noted that the present disclosure is not limited to the scope of the following examples at all.

Preparation Example 1

Preparation of Binder Resin (Polyester Resin)

A polyester resin having a glass transition point ($Tg_r$) of 53.8° C., a softening point ($Tm_r$) of 100.5° C., a number average molecular weight (Mn) of 1,295, a molecular weight distribution (Mw/Mn) of 11.2, an acid value of 16.8 mgKOH/g and a hydroxyl value of 22.8 mgKOH/g was prepared by the following method.

A 5 L four-necked flask was charged with 1245 g of terephthalic acid, 1245 g of isophthalic acid, 1248 g of a bisphenol A ethylene oxide adduct, and 744 g of ethylene glycol. Subsequently, after replacing the atmosphere inside the flask with nitrogen, the temperature within the flask was increased to 250° C. under stirring. Then, after the reaction was performed at normal pressure and 250° C. for 4 hours, 0.875 g of antimony trioxide, 0.548 g of triphenyl phosphate, and 0.102 g of tetrabutyl titanate were added to the flask. Thereafter, the pressure within the flask was reduced to 0.3 mmHg, and the temperature within the flask was increased to 280° C. Subsequently, the contents of the flask were reacted at 280° C. for 6 hours to give a polyester resin having a molecular weight of 13,000. Then, 30.0 g of trimellitic acid was added as a crosslinking agent to the flask, the pressure within the flask was restored to normal pressure, and the temperature within the flask was lowered to 270° C. Thereafter, the contents of the flask were reacted at normal pressure and 270° C. for 1 hour. After completing the reaction, the content of the flask was taken out and cooled, thereby giving a polyester resin.

Preparation Example 2

Preparation of Toner Core

A hundred (100) parts by mass of the binder resin obtained in Preparation Example 1, 5 parts by mass of a coloring agent (C.I. Pigment Blue 15:3, copper phthalocyanine), and 5 parts by mass of a release agent ("WEP-3" manufactured by NOF Corporation, ester wax) were mixed by using a mixer (a Henschel mixer) to obtain a mixture. The thus obtained mixture was melt kneaded by using a two screw extruder ("PCM-30" manufactured by Ikegai Corporation) to give a kneaded product. The kneaded product was pulverized by using a mechanical pulverizer ("Turbo Mill" manufactured by Freund Turbo Corporation) to give a pulverized product. The pulverized product was classified by a classifier ("Elbow Jet" manufactured by Nittetsu Mining Co., Ltd.) to obtain a toner core having a volume average particle size ($D_{50}$) of 6.0 μm and average roundness of 0.93. The volume average particle size of the toner core was measured by using "Coulter Counter Multisizer 3" (manufactured by Beckman Coulter). The average roundness of the toner core was measured by using a flow particle image analyzer ("FPIA-3000" manufactured by Sysmex Corporation).

Examples 1 to 4 and Comparative Examples 3 and 4

Surface Treatment for Toner Core

The toner core was surface-treated with fine particles by using one part by mass of a corresponding type of fine particles shown in Tables 1 and 3 for 100 parts by mass of the tore core obtained in Preparation Example 2. For the surface treatment of the toner core, a Henschel mixer type FM-10 (manufactured by Nippon Coke and Engineering Co., Ltd.) was used. The toner core and the fine particles were put in a treatment tank of the Henschel mixer, and were mixed at a rotational speed of 3000 rpm for 5 minutes, and thus, a toner core having been surface-treated with each type of the fine particles was obtained. Incidentally, as the fine particles shown in Tables 1 and 3 used for the surface treatment of the toner cores, the following commercially available products were used:

Negatively charged wet silica: Nipsil E220 (manufactured by Nippon Silica Industrial Co., Ltd.)

Negatively charged dry silica: Aerosil #200 (manufactured by Nippon Aerosil Co., Ltd.)

Titanium oxide A: Conductive titanium oxide of anatase-type (manufactured by Titan Kogyo Ltd., having electrical resistivity of $10^7$ Ω·cm)

Titanium oxide B: Titanium oxide of rutile-type (manufactured by Ishihara Sangyo Kaisha Ltd., having electrical resistivity of $10^{10}$ Ω·cm)

Positively charged dry silica: REA200 (manufactured by Nippon Aerosil Co., Ltd.)

Positively charged resin beads: FS-393 (manufactured by Nippon Paint Co., Ltd., having charge amount of 300 μC/g)

A part of each of the toner cores thus obtained by the surface treatment with the fine particles was taken out for measuring a frictional charge amount attained by friction with a standard carrier by a method described below. The frictional charge amounts attained by the friction with the standard carrier of these toner cores are shown in Tables 1 and 3.

<Method for Measuring Frictional Charge Amount Attained by Using Standard Carrier>

A standard carrier N-01 (a standard carrier for a negatively chargeable toner) available from The Imaging Society of Japan, and each type of the toner cores in an amount of 7% by mass based on the mass of the standard carrier were mixed for 30 minutes by using a Turbula mixer. The thus obtained mixture was used as a measurement sample. With respect to each measurement sample, the frictional charge amount attained by friction with the standard carrier was measured by using a QM meter ("MODEL 210HS-2A" manufactured by TREK Inc.).

For forming a shell layer, any of the following thermoplastic resins a and b was used.

The thermoplastic resin a was a water soluble polyacrylamide ("BECKAMINE A-1" manufactured by DIC Corporation, an aqueous solution having a solid content concentration of 11% by mass).

The thermoplastic resin b was an acrylamide copolymer (having a solid content concentration of 5% by mass) having a monomer composition, a glass transition point (Tg), and a mass average molecular weight as follows:

Monomer composition (in molar ratio): 2-hydroxyethyl methacrylate/acrylamide/methacrylic acid-methoxy polyethylene glycol=30/50/20

Glass transition point (Tg): 110° C.

Mass average molecular weight: 55,000

(Shell Layer Forming Process)

A 1 L three-necked flask equipped with a thermometer and a stirring blade was charged with 300 mL of ion-exchanged water. Subsequently, the temperature within the flask was retained at 30° C. by using a water bath. Then, dilute hydrochloric acid was added to the flask to adjust the pH of an aqueous medium contained in the flask to 4. After adjusting the pH, 2 mL of a methylol melamine aqueous solution ("mirben resin SM-607" manufactured by Showa Denko K.K., having a solid content concentration of 80% by mass) and 2 mL of an aqueous solution of the thermoplastic resin a (i.e., an aqueous solution of the water soluble polyacrylamide having a solid content concentration of 11% by mass) were added to the flask as materials of the shell layer (shell materials). Then, the contents of the flask were stirred for dissolving the materials of the shell layer in the aqueous medium. In this manner, a shell layer material aqueous solution (A) was obtained.

To the aqueous solution (A), 300 g of the corresponding type of toner core having been treated with the fine particles was added, and the contents of the flask were stirred at a stirring rate of 200 rpm for 1 hour. Subsequently, 300 mL of ion-exchanged water was added to the flask. Then, while stirring the contents of the flask at 100 rpm, the temperature within the flask was increased to 70° C. (that is, a shell layer forming temperature) at a rate of 1° C./min. Thereafter, the contents of the flask were continuously stirred at 70° C. and 100 rpm for 2 hours. Then, the pH of the content of the flask was adjusted to 7 by adding sodium hydroxide to the flask. Subsequently, the content of the flask was cooled to room temperature. In this manner, a dispersion containing toner mother particles was obtained.

Incidentally, toner cores were aggregated in Comparative Examples 3 and 4. This is probably because the surfaces of the toner cores were treated with positively charged fine particles in Comparative Examples 3 and 4, and hence the adhesion, to the toner core surface, of the monomer of the thermosetting resin positively charged similarly to the fine particles was inhibited. It seems that since it is difficult, in such a case, to coat the toner core surface with the shell layer, the toner cores were aggregated when heated at 70° C. Accordingly, the following operation, measurement and evaluation were not performed in Comparative Examples 3 and 4.

(Washing Process)

A wet cake of the toner mother particles was filtered out by using a Buchner funnel from the dispersion containing the toner mother particles. The wet cake of the toner mother particles was dispersed again in ion-exchanged water for washing the toner mother particles. Such filtration and dispersion were repeated five times to wash the toner mother particles.

In the washing process performed in the preparation of the toner of Example 1, a filtrate of the dispersion containing the toner mother particles and washing water used in the washing process were collected as drainage. The amount of the collected drainage was 97 parts by mass based on 100 parts by mass of the toner obtained after a drying process described below. The concentration of total organic carbon (TOC) contained in the collected drainage was 8 mg/L. The concentration of the total organic carbon contained in the drainage was measured by using a TOC analyzer ("TOC-4200" manufactured by Shimadzu Corporation).

(Drying Process)

A slurry was prepared by dispersing the wet cake of the toner mother particles in an ethanol aqueous solution in a concentration of 50% by mass. The thus obtained slurry was supplied to a continuous surface modifying apparatus ("Coatmizer" manufactured by Freund Industrial Co., Ltd.) to dry the toner mother particles contained in the slurry. In this manner, dried toner mother particles were obtained. The drying conditions employed in using Coatmizer were a hot air temperature of 45° C. and a blower air flow rate of 2 $m^3$/min.

(External Addition Process)

A hundred (100) parts by mass of the toner mother particles resulting from the drying process and 1.0 part by mass of silica ("REA90" manufactured by Nippon Aerosil Co., Ltd.) were mixed for 5 minutes by using a 10 L Henschel mixer (manufactured by Nippon Coke and Engineering Co., Ltd.) for adhering the external additive to the toner mother particles. Thereafter, the resultant toner particles were sifted by a 200 mesh sieve (having an opening of 75 μm).

Example 5

A toner of Example 5 was obtained in the same manner as in Example 1 except that the thermoplastic resin b (the aqueous solution of the acrylamide copolymer having a solid content concentration of 5% by mass) was used instead of the thermoplastic resin a.

Examples 6 and 7

Toners of Examples 6 and 7 were respectively obtained in the same manner as in Example 1 except that the amount of the methylol melamine aqueous solution to be used and the amount of the thermoplastic resin a to be used were changed to those shown in Table 2.

Comparative Example 1

A toner of Comparative Example 1 was obtained in the same manner as in Example 1 except that the amount of the methylol melamine aqueous solution was changed to 4 mL and the thermoplastic resin was not used.

Comparative Example 2

A toner of Comparative Example 2 was obtained in the same manner as in Example 1 except that toner cores not surface-treated with the fine particles were used instead of the toner cores surface-treated with the fine particles.

<<Thickness of Shell Layer>>

A TEM photograph of a cross-section of a toner particle contained in each of the toners of Examples 1 to 7 and Comparative Examples 1 and 2 was taken by a method described below. On the basis of the TEM photograph of the cross-section of the toner particle, the thickness of the shell layer was measured by a method described below. The thicknesses of the shell layers of the toners of Examples 1 to 7 and Comparative Examples 1 and 2 are shown in Tables 1 to 3.

<Method for Taking TEM Photograph of Cross-Section of Toner Particle>

First, each toner was dispersed in a cold-setting epoxy resin, and the resultant was allowed to stand still in an atmosphere of 40° C. for 2 days to give a cured substance. The cured substance was dyed with osmium tetroxide. Thereafter, a thin sample with a thickness of 200 nm for observing the cross-section of a toner particle was cut out from the resulting cured substance by using a microtome ("EM UC6" manufactured by Leica). The thus obtained thin sample was observed with magnifying powers of 3000 and 10000 by using a transmission electron microscope (TEM) ("JSM-6700F" manufactured by JEOL Ltd.) to take a TEM photograph of the cross-section of the toner particle.

<Method for Measuring Thickness of Shell Layer>

The thickness of the shell layer was measured by analyzing the TEM photograph image of the cross-section of the toner particle by using image analysis software ("WinROOF" manufactured by Mitani Corporation). Specifically, two straight lines were drawn to cross at substantially the center of the cross-section of the toner particle, and the lengths of four sections of the two straight lines crossing the shell layer were measured. An average of the thus measured lengths of the four sections was defined as the thickness of the shell layer of one toner particle to be measured.

This measurement of the thickness of the shell layer was performed on ten toner particles, so as to obtain an average of the thicknesses of the shell layers of the plural toner particles to be measured. The thus obtained average was determined as the thickness of the shell layer of the toner particle.

<<Evaluation 1>>

With respect to the toners of Examples 1 to 7 and Comparative Examples 1 and 2, the charge stability and the high-temperature preservability were evaluated by methods described below. The evaluation results of the charge stability and the high-temperature preservability of the toners of Examples 1 to 7 and Comparative Examples 1 and 2 are shown in Tables 1 to 3.

<Evaluation of Charge Stability>

A frictional charge amount ($C_{10}$) of each toner obtained when mixed with the standard carrier for 10 minutes, and a frictional charge amount ($C_{60}$) of the toner obtained when mixed with the standard carrier for 60 minutes were measured. The frictional charge amount $C_{10}$ was measured in the same manner as described above as the method for measuring a frictional charge amount except that the time for mixing the toner by using a Turbula mixer was set to 10 minutes. The frictional charge amount $C_{60}$ was measured in the same manner as the frictional charge amount $C_{10}$ except that the time for mixing the toner by using a Turbula mixer was set to 60 minutes. On the basis of the thus measured frictional charge amounts $C_{10}$ and $C_{60}$, a charge amount change ratio ($C_{60}/C_{10}$) was calculated. The charge stability was evaluated in accordance with the following criteria:

G (Good): The change ratio ($C_{60}/C_{10}$) was 1.5 or less.

P (Poor): The change ratio ($C_{60}/C_{10}$) was more than 1.5.

<Evaluation of High-Temperature Preservability>

Two (2) g of each toner was weighed in a 20 mL plastic vessel, and the resultant was allowed to stand still for 3 hours in a thermostat heated at 60° C. Thus, a toner for high-temperature preservability evaluation was obtained. Then, the toner for high-temperature preservability evaluation was sifted by using a 200 mesh sieve (having an opening of 75 μm) under conditions of a rheostat scale of 5 and time of 30 seconds in accordance with an instruction manual of a powder tester (manufactured by Hosokawa Micron K.K.). After sifting, the mass of the toner remaining on the sieve was measured. On the basis of the mass of the toner before sifting and the mass of the toner remaining on the sieve after sifting, a degree of aggregation (% by mass) was obtained in accordance with the following formula. On the basis of the calculated degree of aggregation, the high-temperature preservability was evaluated in accordance with the following criteria.

(Calculation Formula for Degree of Aggregation)

Degree of aggregation (% by mass)=(Mass of toner remaining on sieve/mass of toner before sifting)×100

Good (G): The degree of aggregation was 20% by mass or less.

Normal (N): The degree of aggregation was more than 20% by mass, and 50% by mass or less.

Poor (P): The degree of aggregation was more than 50% by mass.

<<Evaluation 2>>

The toners of Examples 1 to 7 and Comparative Examples 1 and 2 were used for evaluating the low-temperature fixability by a method described below. The low-temperature fixability was evaluated by using a two-component developer prepared as described below. The evaluation results of the low-temperature fixability of the toners of Examples 1 to 7 and Comparative Examples 1 and 2 are shown in Tables 1 to 3.

Preparation Example 3

A developer carrier (a carrier for TASKalfa 5550) and each of the toners in an amount of 10% by mass based on the mass of the carrier were mixed for 30 minutes by using a ball mill. In this manner, a two-component developer was prepared.

<Evaluation of Low-Temperature Fixability>

As an evaluation apparatus, a printer ("FSC-5250DN" manufactured by Kyocera Document Solutions Inc.) modified so that a fixing temperature could be adjusted was used. The two-component developer prepared in Preparation Example 3 was supplied to a developing unit of the evaluation apparatus, and the toner was supplied to a toner container of the evaluation apparatus. The linear speed of the evaluation apparatus was set to 200 mm/sec and the toner placement amount of the evaluation apparatus was set to 1.0 mg/cm$^2$, and an unfixed solid image was formed on a recording medium. The unfixed solid image thus formed was fixed with the fixing temperature of a fixing unit of the evaluation apparatus increased from 100° C. in increments of 5° C. in a range of the fixing temperature from 100° C. inclusive to 200° C. inclusive. Thus, a lowest temperature at which the solid image could be fixed on a recording medium without offset was obtained as a lowest fixing temperature. The low-temperature fixability was evaluated in accordance with the following criteria:

Good (G): The lowest fixing temperature was 160° C. or less.

Poor (P): The lowest fixing temperature was more than 160° C.

TABLE 1

| | Examples | | | |
|---|---|---|---|---|
| | 1 | 2 | 3 | 4 |
| Toner core particle surface treatment | | | | |
| Type of fine particles | Negatively charged wet silica | Negatively charged dry silica | Titanium oxide A | Titanium oxide B |
| Frictional charge amount [μC/g] | −10 | −15 | −5 | −5 |
| Shell layer material | | | | |
| Type of monomer of thermosetting resin | Methylol melamine | Methylol melamine | Methylol melamine | Methylol melamine |
| Amount [mL] | 2.0 | 2.0 | 2.0 | 2.0 |
| Type of thermoplastic resin | a | a | a | a |
| Amount [mL] | 2.0 | 2.0 | 2.0 | 2.0 |
| Shell layer thickness [nm] | 10.0 | 10.0 | 10.0 | 10.0 |
| Charge stability Frictional charge amount of toner particle | | | | |
| Charge amount after 10 min mixing ($C_{10}$) [μC/g] | 40.0 | 30.0 | 20.0 | 40.0 |
| Charge amount after 60 min mixing ($C_{60}$) [μC/g] | 50.0 | 40.0 | 30.0 | 50.0 |
| Charge amount change ratio ($C_{60}/C_{10}$) | 1.25 | 1.33 | 1.50 | 1.25 |
| Evaluation result High-temperature preservability | G | G | G | G |
| Evaluation result Low-temperature fixability | G | G | G | G |
| Lowest fixing temperature [° C.] | 135 | 140 | 140 | 140 |
| Evaluation result | G | G | G | G |

TABLE 2

| | Example | | |
|---|---|---|---|
| | 5 | 6 | 7 |
| Toner core particle surface treatment | | | |
| Type of fine particles | Negatively charged wet silica | Negatively charged wet silica | Negatively charged wet silica |
| Frictional charge amount [μC/g] | −10 | −10 | −10 |
| Shell layer material | | | |
| Type of monomer of thermosetting resin | Methylol melamine | Methylol melamine | Methylol melamine |
| Amount [mL] | 2.0 | 0.2 | 4.0 |
| Type of thermoplastic resin | b | a | a |
| Amount [mL] | 2.0 | 0.2 | 4.0 |
| Shell layer thickness [nm] | 10.0 | 1.0 | 20.0 |
| Charge stability Frictional charge amount of toner particle | | | |
| Charge amount after 10 min mixing ($C_{10}$) [μC/g] | 20.0 | 10.0 | 60.0 |

TABLE 2-continued

| | Example | | |
|---|---|---|---|
| | 5 | 6 | 7 |
| Charge amount after 60 min mixing ($C_{60}$) [μC/g] | 30.0 | 15.0 | 80.0 |
| Charge amount change ratio ($C_{60}/C_{10}$) | 1.50 | 1.50 | 1.33 |
| Evaluation result High-temperature preservability | G | G | G |
| Evaluation result Low-temperature fixability | G | N | G |
| Lowest fixing temperature [° C.] | 140 | 130 | 150 |
| Evaluation result | G | G | G |

TABLE 3

| | Comparative Example | | | |
|---|---|---|---|---|
| | 1 | 2 | 3 | 4 |
| Toner core particle surface treatment | | | | |
| Type of fine particles | Negatively charged wet silica | — | Positively charged dry silica | Positively charged resin beads |
| Frictional charge amount [μC/g] | −10 | −5 | −10 | 10 |
| Shell layer material | | | | |
| Type of monomer of thermosetting resin | Methylol melamine | Methylol melamine | Methylol melamine | Methylol melamine |
| Amount [mL] | 4.0 | 2.0 | 2.0 | 2.0 |
| Type of thermoplastic resin | — | a | a | a |
| Amount [mL] | — | 2.0 | 2.0 | 2.0 |
| Shell layer thickness [nm] | 10.0 | 10.0 | 10.0 | 10.0 |
| Charge stability Frictional charge amount of toner particle | | | | |
| Charge amount after 10 min mixing ($C_{10}$) [μC/g] | 80.0 | 50.0 | — | — |
| Charge amount after 60 min mixing ($C_{60}$) [μC/g] | 140.0 | 90.0 | — | — |
| Charge amount change ratio ($C_{60}/C_{10}$) | 1.75 | 1.80 | — | — |
| Evaluation result High-temperature preservability | P | P | — | — |
| Evaluation result Low-temperature fixability | G | G | — | — |
| Lowest fixing temperature [° C.] | 170 | 140 | — | — |
| Evaluation result | P | G | — | — |

In each of Examples 1 to 7, the toner particle contained in the toner includes the toner core containing the binder resin, and the shell layer coating the surface of the toner core. Besides, the shell layer contains a unit derived from the monomer of the thermosetting resin and a unit derived from the thermoplastic resin. Furthermore, the thermosetting resin is one or more resins selected from the group of amino resins consisting of a melamine resin, a urea resin, and a glyoxal resin. In addition, the fine particles having the charge property opposite to that of the toner, or the fine particles having the volume resistivity lower than those of both the binder resin and the shell layer are contained in the interfacial portion between the toner core and the shell layer. In these toners of Examples 1 to 7, the excessive charging of the toner particles can be inhibited in continuously forming images, and the high-temperature preservability and the low-temperature fixability are excellent as shown in Tables 1 to 3.

In Comparative Example 1, the toner particle contained in the toner includes the shell layer containing the resin not having a unit derived from a thermoplastic resin. This toner of Comparative Example 1 is poor in the low-temperature fixability as shown in Table 3. More specifically, in the toner of Comparative Example 1, even if a temperature and a pressure are applied to the toner particle in a fixing operation, the shell layer is not easily broken, and hence the toner cannot be satisfactorily fixed. This is probably because the shell layer containing merely the unit derived from the monomer of the thermosetting resin does not contain a unit derived from a thermoplastic resin, and therefore, the resulting shell layer is highly crosslinked and hence is lowered in the flexibility.

In Comparative Example 2, the toner particle contained in the toner does not include the fine particles in the interfacial portion between the toner core and the shell layer. In this toner of Comparative Example 2, the excessive charging of the toner particle could not be inhibited in continuously forming images as shown in Table 3. If the fine particles having the charge property opposite to that of the toner are contained in the interfacial portion between the toner core and the shell layer, it is presumed that the potential on the toner particle surface could be controlled at an appropriate level owing to the charge of a polarity opposite to that of the toner caused on the surfaces of the fine particles. Alternatively, if fine particles having a volume resistivity lower than those of both the binder resin and the shell layer are contained in the interfacial portion between the toner core and the shell layer, it is presumed that free electrons present on the toner core surface or in the shell layer could move through the fine particles so as to control the potential on the toner particle surface at an appropriate level. On the other hand, in the toner of Comparative Example 2, since such a function of the fine particles contained in the interfacial portion of the toner core and the shell layer cannot be obtained, it is presumed that the excessive charging of the toner particles could not be inhibited in continuously forming images.

What is claimed is:

1. An electrostatic latent image developing toner, comprising toner particles each containing:

a toner core containing a binder resin; and a shell layer coating a surface of the toner core, wherein the shell layer is a film that contains a unit derived from a monomer of a thermosetting resin, and a unit derived from a thermoplastic resin, the thermosetting resin is one or more resins selected from the group of amino resins consisting of a melamine resin, a urea resin, and a glyoxal resin, the toner particle contains fine particles in an interfacial portion between the toner core and the shell layer, and the fine particles in the interfacial portion between the toner core and the shell layer have a charge property opposite to that of the toner, or have a volume resistivity lower than both a volume resistivity of the binder resin and a volume resistivity of the shell layer.

2. An electrostatic latent image developing toner according to claim 1, wherein a frictional charge amount of the toner core is −20 μC/g or more and −5 μC/g or less, and the frictional charge amount is measured by mixing a standard carrier and the toner core having the fine particles adhered thereto in an amount of 7% by mass based on a mass of the standard carrier by using a Turbula mixer for 30 minutes.

3. An electrostatic latent image developing toner according to claim 1, wherein the shell layer has a thickness of 1 nm or more and 20 nm or less.

4. An electrostatic latent image developing toner according to claim 1, wherein the fine particles have a volume resistivity of $10^5$ Ω·cm or more and $10^{10}$ Ω·cm or less.

5. An electrostatic latent image developing toner according to claim 1, wherein the fine particles are negatively chargeable silica.

6. An electrostatic latent image developing toner according to claim 1, wherein the binder resin has a glass transition point ($Tg_r$) of 30° C. or more and 60° C. or less.

7. An electrostatic latent image developing toner according to claim 1, wherein a content of a nitrogen atom in the shell layer is 10% by mass or more.

8. An electrostatic latent image developing toner according to claim 1, wherein a ratio (Ws/Wp) of a content (Ws) of the unit derived from the monomer of the thermosetting resin in the shell layer to a content (Wp) of the unit derived from the thermoplastic resin is 3/7 or more and 8/2 or less.

9. An electrostatic latent image developing toner according to claim 1, wherein the unit derived from the thermoplastic resin is crosslinked by the unit derived from the monomer of the thermosetting resin.

10. An electrostatic latent image developing toner according to claim 1, wherein the toner is positively chargeable, the fine particles in the interfacial portion between the toner core and the shell layer are negatively chargeable, and the negatively chargeable fine particles in the interfacial portion between the toner core and the shell layer are one or more selected from the group consisting of silica fine particles, titanium oxide fine particles, alumina fine particles, and acrylic resin beads.

11. An electrostatic latent image developing toner according to claim 10, wherein the negatively chargeable fine particles are surface-treated with a silane coupling agent.

12. An electrostatic latent image developing toner according to claim 1, wherein the fine particles in the interfacial portion between the toner core and the shell layer have a volume resistivity lower than both a volume resistivity of the binder resin and a volume resistivity of the shell layer, and the fine particles in the interfacial portion between the toner core and the shell layer are one or more selected from the group consisting of titanium oxide fine particles, tin oxide fine particles, silicon carbide fine particles, zinc oxide fine particles, strontium titanate fine particles, and carbon black fine particles.

* * * * *